United States Patent [19]

Smith

[11] Patent Number: 4,586,524

[45] Date of Patent: May 6, 1986

[54] CLOTHES HANGER HANDLE FOR UMBRELLAS

[76] Inventor: Frank Smith, 553½ Washington St., Venice, Calif. 90291

[21] Appl. No.: 644,863

[22] Filed: Aug. 27, 1984

[51] Int. Cl.[4] ..... A45B 3/00; A47F 5/08; A41D 27/22

[52] U.S. Cl. ..... 135/16; D3/12; 211/118; 223/89; 223/94

[58] Field of Search ..... 135/16, 19, 98, 20 R, 135/17, 66; 211/118, 119; 223/90, 91, 92, 94, 85, 89; D6/318, 316, 309, 324, 325, 321, 327, 328; D8/107; D3/5, 12, 13, 14, 15, 11

[56] References Cited

U.S. PATENT DOCUMENTS

| | | | |
|---|---|---|---|
| 490,416 | 1/1893 | Sutton et al. | 135/66 |
| 779,449 | 1/1905 | Wagner | 135/66 X |
| 1,030,253 | 6/1912 | Doyle | 223/94 X |
| 1,111,147 | 9/1914 | Fogde | 223/89 |
| 1,114,002 | 10/1914 | Kalina | 223/94 |
| 1,145,994 | 7/1915 | Jasinski | 135/66 X |
| 2,120,436 | 6/1938 | Fallot | 211/118 |
| 2,290,722 | 7/1942 | Weingarten | 223/94 |
| 2,425,527 | 8/1947 | Gaudino | 223/94 |
| 2,493,385 | 1/1950 | Boyd | 223/89 |
| 3,245,421 | 4/1966 | Braun et al. | 135/16 |

FOREIGN PATENT DOCUMENTS

| | | | |
|---|---|---|---|
| 843464 | 3/1962 | Canada | 211/118 |
| 41855 | 3/1930 | Denmark | 223/94 |
| 175482 | 1/1904 | Fed. Rep. of Germany | 135/66 |
| 349689 | 3/1922 | Fed. Rep. of Germany | 135/16 |
| 599535 | 3/1948 | United Kingdom | 223/94 |
| 640774 | 7/1950 | United Kingdom | 223/89 |

*Primary Examiner*—Robert A. Hafer
*Assistant Examiner*—D. Neal Muir
*Attorney, Agent, or Firm*—Matthew F. Jodziewicz

[57] ABSTRACT

The present invention provides a handle assembly for umbrellas, or the like, which comprises: a head member adapted to attach to one end of a central rod of an umbrella; at least two arms pivotally mounted on said head member to swing in their respective radial planes through arcs of about 135 degrees, from an inoperative, folded position extending generally parallel a longitudinal axis of said central rod to an operative, unfolded position, extending away from said longitudinal axis in a predetermined angular relation to said axis and capable of acting as a hanger for clothing in this operative, unfolded position; means attached to said head member for hanging said umbrella.

12 Claims, 7 Drawing Figures

CLOTHES HANGER HANDLE FOR UMBRELLAS

BACKGROUND OF THE INVENTION

1. Field of the Invention

This invention relates to an adaptable umbrella or the like handle that provides a means to utilize the umbrella in its folded and unused state as a clothing hanger, thus minimizing the possibility that upon leaving a given location the umbrella's owner will remember to take his coat but leave the umbrella behind. This forgetfulness is far from being merely a minor annoyance to individuals. It is first costly to continue to leave one's umbrella behind. Secondly, it provides the owner of the misplaced umbrella with the opportunity to rue his mistake by becoming soaked in an ensuing downpour, thus possibly ruining expensive evening clothes. Finally, the embarrassment of a forgotten article is a misfortune that we all can avoid.

2. Description of the Prior Art

Having made an extensive examination and search of the existing prior art, the applicant found only four references that were of interest. Each of these is described below in detail.

The German Balke Pat. No. 349689 patent reference discloses a cane-type walking apparatus which may be converted into a hanger-type suspension means for clothing and the like. Balke, however, goes about transforming its cane walking apparatus into its hanger-type apparatus in a fundamentally different way than that proposed by the applicant herein. The arms b are pivotally attached adjacent the upper end of the cane, and rotate radially upward to be held in place by collar d and retaining pin e. When not in use, arms b are folded downward and are held by retaining collar g. In applicant's invention, the arms are pivotally attached to a head which is in turn attached to the handle. This permits the invention to be added as a modification to an existing umbrella or the like. Also applicant's invention provides that its arms are rotated upward and in one alternative embodiment recessed into the head member of the invention. There is thus no need for the retaining collar g nor the sustaining means illustrated by elements d and e in FIG. 1 of Balke.

Doyle U.S. Pat. No. 3,407,825 relates to an umbrella holder that is cited herein as being of interest because of swing arms 41. Upon inspection, however, it is readily seen that swing arms 41 are fixed in position to element 18 and thus cannot be recessed into the head member of the instant invention as is provided for herein.

The remaining two references are the O'Neil U.S. Pat. No. 3,091,249 for an umbrella with a stand attached thereto, and the Harris U.S. Pat. No. 1,982,097 directed to an umbrella support. These references are cited as being of general interest to understand the state of the art and to indicate the extent of the applicant's search thereof. They are however, clearly distinct from the instant invention and neither anticipate it nor render it obvious.

OBJECTIVES AND SUMMARY OF THE INVENTION

It is an object of the present invention to provide an adaptable handle for use with an umbrella or the like that can be converted simply and quickly into a hanger for clothing and hung in a closet or the like location.

It is another object of the invention to provide an adaptable handle for use with an umbrella or the like that can be retrofitted to existing umbrellas or the like in an economic fashion that will provide the adapted umbrella the ability to be used as a hanger for clothing or the like items.

It is yet another object of the invention to provide an adaptable handle for use with an umbrella or the like that can be used as a hanger for clothing or the like items that is sturdy, strong and economical in manufacture.

In a preferred embodiment the invention is directed to a handle assembly for umbrellas and the like comprising a head member adapted to removably attach to one end of a central rod of an umbrella. There are at least two arms pivotally mounted on the head member to swing in their respective radial planes through arcs of about 90 to about 135 degrees, from a inoperative, folded position extending generally parallel a longitudinal axis of the central rod to an operative, unfolded position, extending away from the longitudinal axis in a predetermined angular relation to the axis and capable of acting as a hanger for clothing or the like items in this operative, unfolded position. A hanging means is attached to the head member of the assembly for hanging the umbrella or like item in a closet or like location. In the preferred embodiment this hanging means is a hook attached to the head member.

In a second alternative preferred embodiment the device of the invention comprises a head member adapted to attach to a central rod of an umbrella and has at least two cavities therein adapted to receive and retain therein at least a portion of the arms described above. The arms are pivotally mounted on the head member in alignment with the cavities and have their pivots operatively received and retained in a slot in the arms adapted to permit the arms to be moved from a first position having the arms at least partially received and retained in the cavities to a second operative, opened position having the arms withdrawn from the cavities and positioned for receiving clothing or the like to be hung thereon. It is also taught herein that these arms may be telescopic in construction to selectively vary the length of the arms as desired.

Another preferred embodiment of a handle assembly for umbrellas or the like, constructed in accordance with the invention comprises a head member adapted to attach to a central rod of an umbrella and having at least two arms pivotally mounted on the head member to selectively swing from a first, inoperative folded position extending toward a tip of the umbrella and generally parallel the central rod of the umbrella, to a second, unfolded position, extending away from the central rod of the umbrella in a predetermined angular relation to the central rod of the umbrella. There is also automatic resilient latching means on the central rod of the umbrella, spring loading the arms toward the second, unfolded position and yieldably retaining the arms in the second position. It is preferred that this automatic resilient latching means on the central rod of the umbrella be a spring biased catch member that is urged through at least one slot in the central rod of the umbrella and is normally and yieldingly held in position for engagement in an abutting relation with each of the arms adjacent the central rod of the umbrella. Means are also provided on the central rod of the umbrella to releasably retain the arms in the first inoperative folded position. Finally there is means attached to the head member for hanging the umbrella.

A last preferred embodiment of a handle assembly for umbrellas or the like, constructed in accordance with the invention, comprises a head member adapted to attach to one end of a central rod of an umbrella having a first and a second J-shaped hook-like member each attached to the head member and adapted to swing from a first closed position adjacent and in alignment with one another to form a single J-shaped hook-like assembly, to a second, open position where the first and the second J-shaped hook-like members have been rotated about an axis generally parallel a longitudinal axis of the central rod of the umbrella. There is attached to the head member a third J-shaped hook-like member adapted to be received between the first and the second J-shaped hook-like members in the first closed position and to be exposed in the second open position for hanging the umbrella. The third J-shaped hook-like member may be integrally formed with the head member so that the first and second J-shaped hook-like members may be hingedly connected to the third J-shaped hook-like member.

Other objects and advantages of the invention will be apparent from the claims, the description of the drawings and the description of the preferred embodiments of the invention which are to follow.

DESCRIPTION OF THE PREFERRED EMBODIMENT OF THE INVENTION

Referring to the figures of drawings wherein like numbers of reference designate like elements throughout, a preferred embodiment of a handle assembly 2 for use with umbrellas, walking canes and the like, constructed in accordance with the invention disclosed herein, is shown in a transverse sectional view of handle assembly 2 mounted on a central rod 4 of an umbrella.

Head member 6 is adapted to mount on an end 8 of central rod 4 in a conventional manner.

Figure 1:
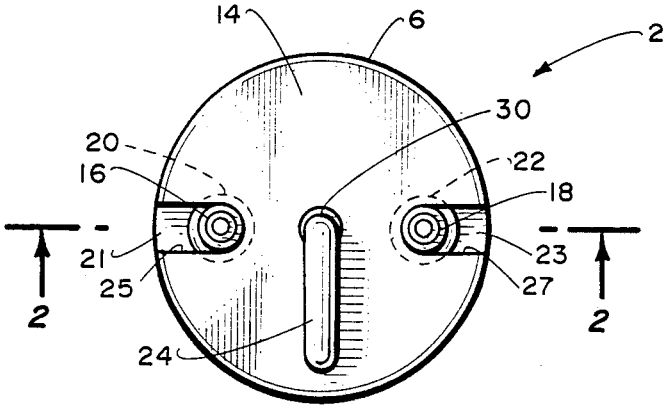
FIG. 1 is a top plan view of a handle made in accord with the present invention.
Figure 2:
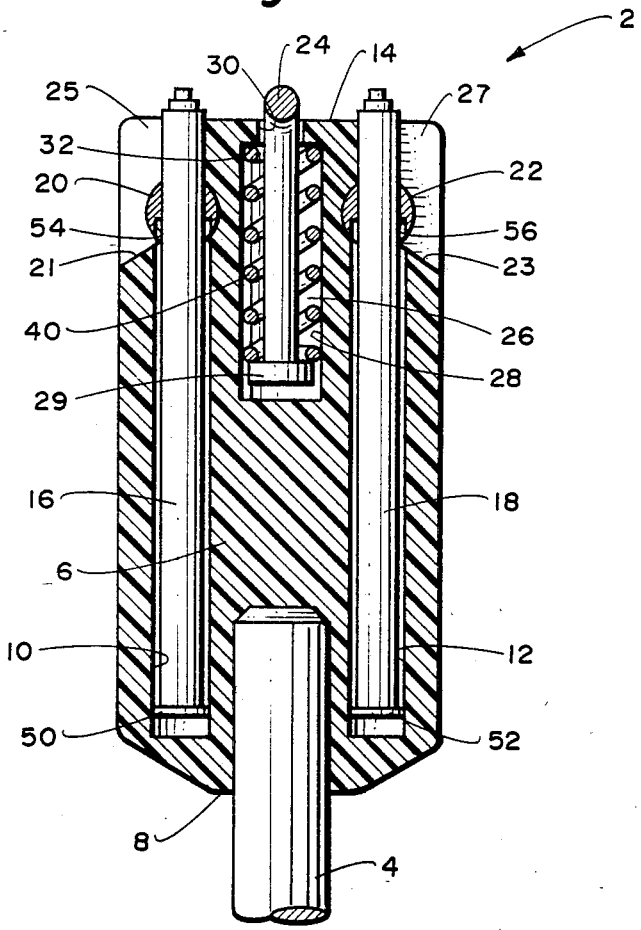
FIG. 2 is a cross-sectional side view taken along the line 2—2 of FIG. 1.
Figure 3:
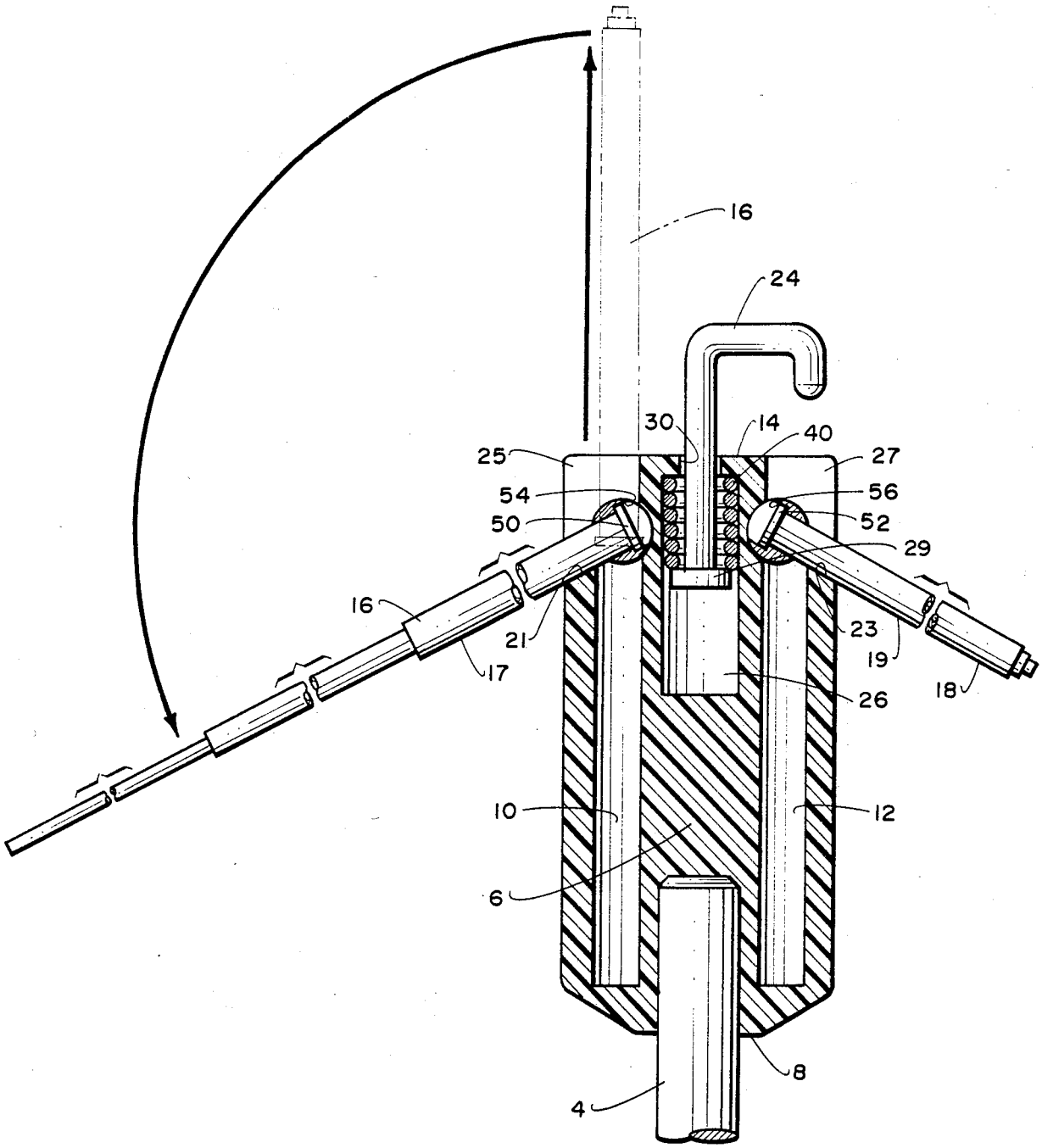
FIG. 3 is a view similar to that of FIG. 2 showing the hanger arms and hanging hook of the invention fully extended from their retracted positions to form the hanger of the invention.

Head member 6 has a first and a second recess, 10 and 12 respectively, in its upper surface 14. These two recesses 10 and 12, are each adapted to receive and retain therein, a telescoping arm, 16 and 18 respectively, when the arms are in their collapsed state as is shown in FIG. 2. Arms 16 and 18 are also adjustably mounted to head member 6 by conventional ball joint arrangements 20 and 22, so that arms 16 and 18 can be fully collapsed into recesses 10 and 12 as is shown in FIG. 2, or can be withdrawn from recesses 10 and 12 by extending telescoping arms 16 and 18 and swinging each arm in its respective radial plane through arcs of about 90 to 135 degrees to form a hanger for clothing or the like as is shown in FIG. 3. It is preferred that arms 16 and 18 swing through arcs greater than 90 degrees to point generally downward to better accommodate the hanging cut of clothing.

The bores through ball sockets 20 and 22 have enlarged sections 54 and 56 respectively, adapted to receive and retain therein in an abutting relation flared annular portions 50 and 52 of arms 16 and 18 respectively as shown in FIG. 3. Thus, arms 16 and 18 when fully extended, may be swiveled, but cannot be withdrawn from their respective ball joints.

Arms 16 and 18 are stopped and braced from further downward arcuate movement by engaging their sidewalls 17 and 19 respectively in an abutting relation with the lower walls 21 and 23 of slots 25 and 27 respectively.

A hook member 24 is releasably held in a third recess 26 in upper surface 14 of head member 6 by a helical spring 40 operatively connected between the enlarged head 29 of hook 24 and the upper end 32 of recess 26. Spring 40, shown in FIGS. 2 and 3, is naturally biased by compressing forces when hook 24 is pulled from recess 26 to urge hook 24 to return to its recessed position. In this fully retracted position, hook member 24 is out of the way until it is to be used. When desired, hook member 24 may be pulled upward from recess 26 and used as a means to hang the assembly in a closet or on a peg as any conventional closet or clothing hanger.

Figure 4:
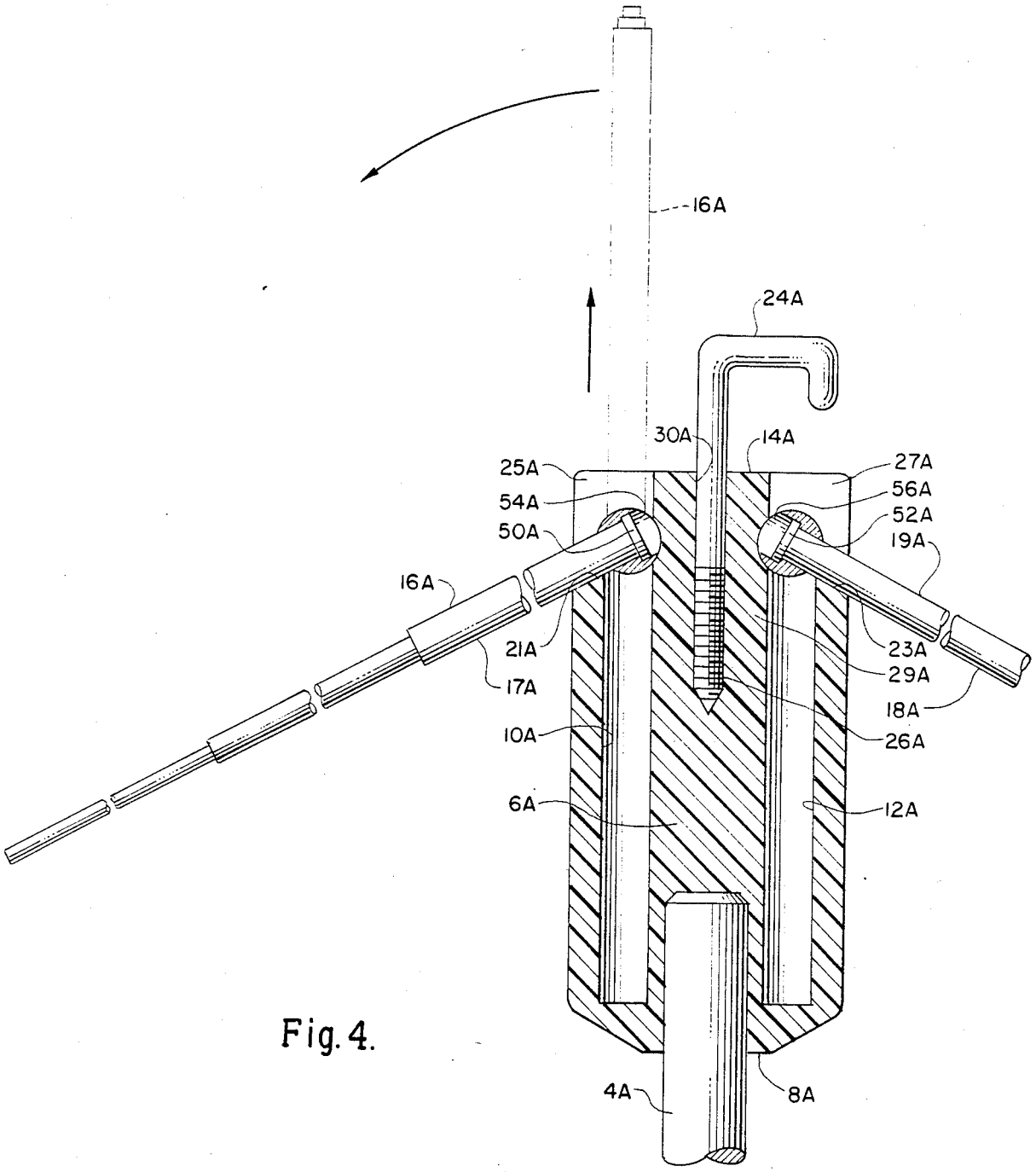
FIG. 4 is a partial cross sectional view similar to FIG. 2 showing the hook member of the invention being selectively removable by having its lower end adapted with screw threads.

FIG. 4 shows an alternate embodiment of the invention wherein indicated reference numbers 4A et seq. are equivalent to reference numbers 4 et seq. respectively except where indicated otherwise. Hook 24A is shown to be selectively removable from head member 14A by having its lower end 26A adapted to screw into head member 14A.

Figure 5:
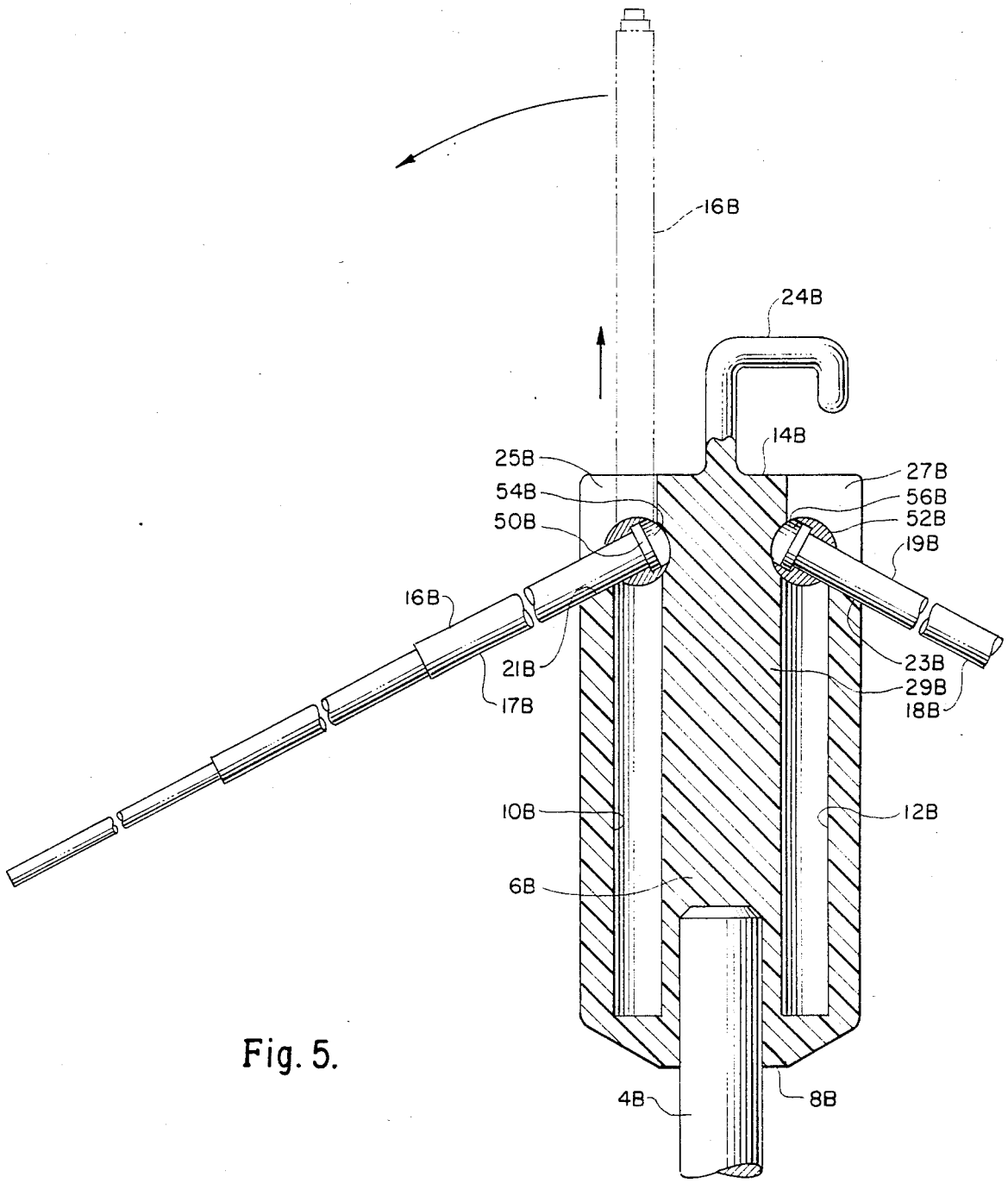
FIG. 5 is a partial cross sectional view similar to FIG. 2 showing the hook member of the invention as a hanging means integral with the handle member.

FIG. 5 shows an alternate embodiment of the invention wherein indicated reference numbers 4B et seq. are equivalent to reference numbers 4 et seq. respectively except where indicated otherwise. Hook 24B is shown to be integrally formed with head member 14B.

It is preferred that hook member 24 be rotatable once withdrawn from recess 26. This can be accomplished by preventing hook member 24 from being removable from recess 26 by enlarging its lower end 28 to form an enlarged head 29 so that enlarged head 29 will not pass through opening 30 defined by the upper end 32 of recess 26.

The apparatus of the invention described above in a preferred embodiment, may be used in connection with an umbrella as follows.

Once the umbrella is no longer to be used, it is closed and folded. Arms 16 and 18 are withdrawn from their recesses 10 and 12 by extending their telescopic sections upward. The arms are now swung in their respective radial planes until they are stopped in their movement by lower walls 21 and 23 of slots 25 and 27 respectively. At this point the arms form the "shoulder" portion of the hanger.

To complete the conversion to a fully functional clothing hanger, hook member 24 is grasped and pulled from its recessed position in recess 26. The assembly is now fully functional as a clothing hanger.

To return the assembly to its initial form, the above described steps are reversed, i.e., hook member 24 and arms 16 and 18 are collapsed and returned to their respective recesses in head member 6.

Figure 7:
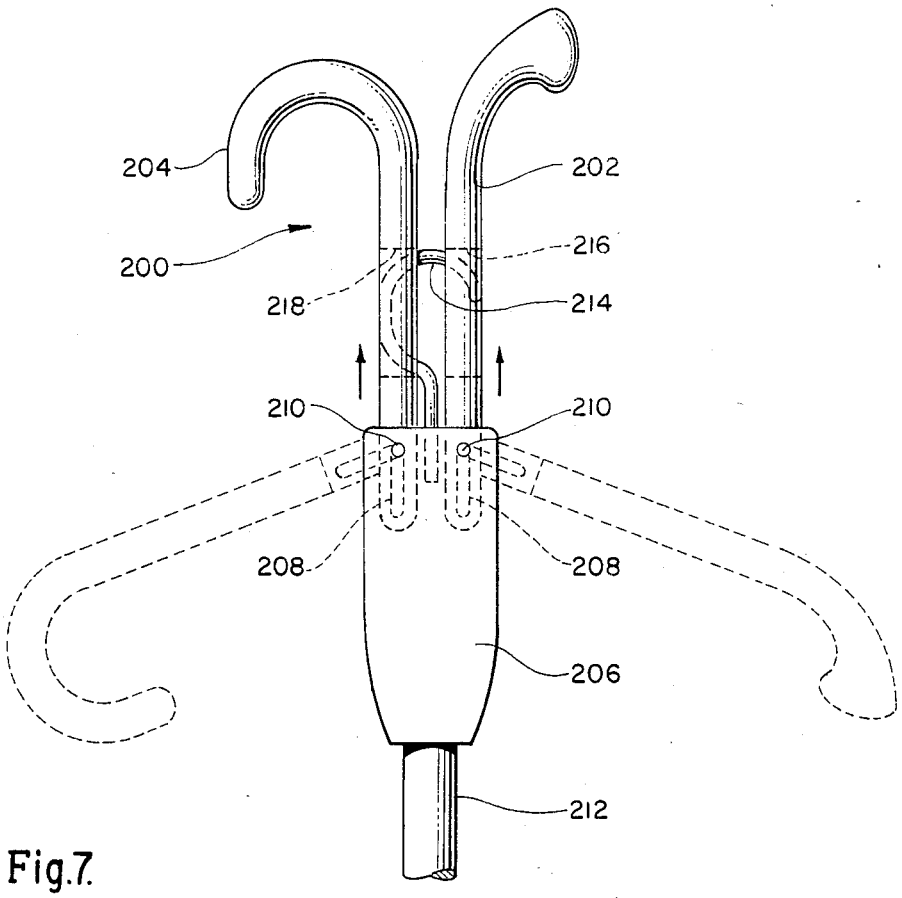
FIG. 7 is a side view of a handle assembly made in accordance with the present invention showing the arm means in their folded, non-supporting position.

An alternate preferred embodiment of a handle assembly constructed in acordance with the invention disclosed herein, illustrated in FIG. 7, would comprise having a handle assembly 200 similar to that described above except that the arms 202 and 204 would be rigid and operatively connected to the head member 206 in a slidably adjustable manner by means of a slot 208 in each arm 202 and 204 which is engaged around a pivot pin 210 to the head member 206.

In this embodiment arms 202 and 204 have an open position wherein the arms extend in a radial manner outwardly from the head member 206 for hanging clothes on the arms, and the arms have a closed position wherein the arms extend longitudinally away from the central rod 212, the arms 202 and 204 cover the hook 214 in slots 216 and 218 in each arm 202 and 204 respectively to form a handle for carrying the umbrella.

Yet another alternate preferred embodiment of a handle assembly for umbrellas or the like, constructed in accordance with the invention disclosed herein, would comprise a head member adapted to attach to a central rod of an umbrella and has at least two arms pivotally mounted on the head member to selectively swing from a first, inoperative folded position extending toward a tip of the umbrella and generally parallel the central rod of the umbrella, to a second, unfolded position, extending away from the central rod of the umbrella in a predetermined angular relation to the central rod of the umbrella. These arms may be of either telescopic or rigid construction as described above.

An automatic resilient latching means would be attached on the central rod of the umbrella, spring loading the arms toward the second, unfolded position and yieldably retaining the arms in the second position. It is preferred that this automatic resilient latching means on the central rod of the umbrella be a spring biased catch member that is urged through at least one slot in the central rod of the umbrella and is normally and yieldingly held in position for engagement in an abutting relation with each of the arms adjacent the central rod of the umbrella. This automatic resilient latching means is preferred to be constructed similar to the spring loaded catch found in present umbrella construction to hold the protective cover of the umbrella in its open position.

Means are also provided on the central rod of the umbrella to releasably retain the arms in the first inoperative folded position. This is accomplished by any of the conventionally known latches or rings currently in use to hold spring loaded members in a selectively retained relation.

Finally there is is a J-shaped hook-like member attached to the head member for hanging the umbrella. This J-shaped hook-like member may be recessed as described above in the embodiment illustrated in the drawings, or it may be attached by having its lower end portion adapted to be screwed into the head member in a removable manner.

Figure 6:
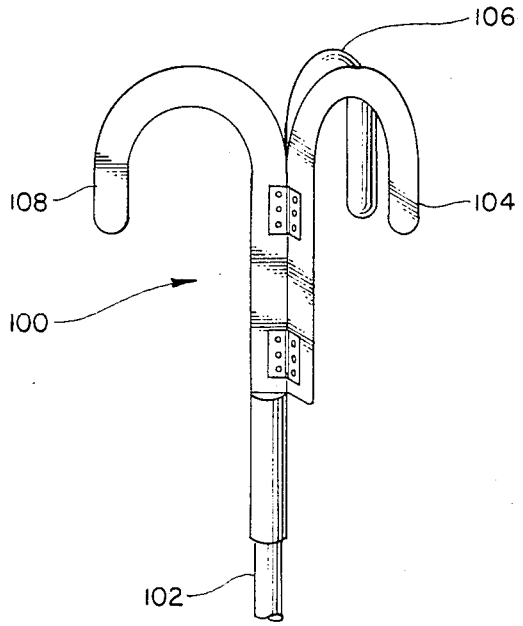
FIG. 6 is a side view showing a J shaped hook member of the invention as a hanging means and showing arm means.

A last described preferred embodiment of a handle assembly for umbrellas or the like, constructed in accordance with the invention disclosed herein, would comprise a head member 100 adapted to attach to one end of a central rod 102 of an umbrella having a first 104 and a second 106 J-shaped hook-like member each attached to the head member 100 and adapted to swing from a first closed position adjacent and in alignment with one another to form a single J-shaped hook assembly, to a second, open position where the first and the second J-shaped hook-like members have been rotated about an axis generally parallel a longitudinal axis of the central rod of the umbrella. This is generally shown in FIG. 6.

There is attached to the head member a third J-shaped hook-like member 108 adapted to be received between the first 104 and the second 106 J-shaped hook-like members in the first closed position and to be exposed in the second open position for hanging the umbrella.

For illustrative purposes only, it will be noted that the assembly described herein resembles a three-ganged fishing hook when it is in the second open position for hanging the umbrella. Two of the "hook"-like members will provide the arm members for hanging clothing and the remaining "hook"-like member will provide a means to hang the umbrella and the associated clothing hanging thereon. The third J-shaped hook-like member 108 may be integrally formed with the head member 100 so that the first and second J-shaped hook-like members 104 and 106 may be hingedly connected to the third J-shaped hook-like member 108.

Although I have illustrated and described only a limited number of preferred forms of the invention, I am aware of the fact that modifications, changes and amendments can be made therein by any person skilled in the art without departing from the scope of the invention as expressed in the claims. Therefore, I do not wish to be limited to the details of construction herein shown and described, but intend to claim all modifications, changes or amendments thereto which may be readily apparent from a reading of the following claims.

I claim:

1. A handle assembly for umbrellas or the like, said assembly comprising:

a central rod to an umbrella;

a head member adapted to attach to said central rod of an umbrella;

at least two arms pivotally mounted on said head member, each arm mounted by means of a ball joint having a ball member rotatably retained in a socket recess in said head member wherein said arms are slidably retained in a passage through said ball member to swing in their respective radial planes through arcs of about 135 degrees, from an inoperative, folded position recessed in said head member and extending generally parallel said central rod to an operative, unfolded position by withdrawing said arms from said recessed position in said head assembly in a line generally parallel said central rod, rotating and extending said arms outwardly and away from said central rod to a predetermined angular relation to said central rod wherein said arms extend downwardly beyond a horizontal line perpendicular to said central rod and capable of acting as a hanger for clothing in this operative and unfolded position;

means attached to said head member for hanging said umbrella.

2. The handle assembly in accordance with claim 1 wherein said means attached to said head member for hanging said umbrella is a hook.

3. The handle assembly in accordance with claim 2 wherein said hook is selectively removable from said head member.

4. The handle assembly in accordance with claim 3 wherein said hook is selectively removable from said head member by having its lower end adapted to screw into said head member.

5. The handle assembly in accordance with claim 2 wherein said hook is integrally formed with said head member.

6. The handle assembly in accordance with claim 1 wherein said head member has at least two cavities therein adapted to receive and retain therein at least a portion of said arms and having said arms pivotally mounted to said head member in alignment with said cavities and having said pivots operatively received and retained in a slot in said arms adapted to permit said arms to be moved from a position having the arms at least partially received and retained in said cavities to said inoperative, folded position having said arms withdrawn from said cavities.

7. The handle assembly in accordance with claim 1 further including means to selectively adjust the length of said arms.

8. The handle assembly in accordance with claim 7 wherein said means to selectively adjust the length of said arms is by having said arms telescopic in their construction.

9. A handle assembly for umbrellas and the like, said assembly comprising:

a central rod to an umbrella;

a head member attached to said central rod of an umbrella, said head member having a first and a second recess therein adapted to receive and retain in each of said recesses a telescoping arm pivotally mounted on said head member by means of a ball joint having a ball member rotatably retained in a socket recess in said head member wherein said arms are slidably retained in a passage through said ball member to swing in their respective radial planes through arcs of about 135 degrees, from an inoperative, collapsed position extending generally parallel said central rod retracted in said first and second recesses in said head member, to an operative, telescoped position, extending generally outward and away from said central rod in a predetermined angular relation to said central rod and capable of acting as a hanger for clothing in this operative, telescoped position;

means attached to said head member for hanging said umbrella.

10. The handle assembly in accordance with claim 9 wherein said means attached to said head member for hanging said umbrella is a hook adapted to selectively move from a first position recessed into said head member to an extended position capable of holding said umbrella in a hanging relation.

11. The handle assembly in accordance with claim 10 further including means operatively connected to said hook to naturally urge said hook to return to said recessed position.

12. The handle assembly in accordance with claim 11 wherein said means operatively connected to said hook to naturally urge said hook to return to said recessed position is a helical spring operatively connected to said hook and adapted to be compressed to exert a force naturally urging said hook to return to said recessed position whenever said hook is placed into said extended position.

* * * * *